United States Patent [19]

Long

[11] 3,965,588

[45] June 29, 1976

[54] IRONING BOARDS

[76] Inventor: Harry L. Long, P.O. Box 1057, Norman, Okla. 73069

[22] Filed: May 19, 1975

[21] Appl. No.: 578,602

[52] U.S. Cl. ..... 38/103; 108/116; 108/144

[51] Int. Cl.[2] ..... D06F 81/00

[58] Field of Search ..... 38/103, 139; 108/6, 108/115, 116, 144, 149, 152, 160, 33, 34, 35, 39–41

[56] References Cited

UNITED STATES PATENTS

| | | | |
|---|---|---|---|
| 1,210,095 | 12/1916 | Noack | 108/33 |
| 1,940,128 | 12/1933 | Howard | 108/116 X |
| 2,646,634 | 7/1953 | Mongar | 108/116 X |
| 3,730,107 | 5/1973 | Bergkamp et al. | 108/39 |

*Primary Examiner*—George V. Larkin
*Attorney, Agent, or Firm*—Laney, Dougherty, Hessin & Fish

[57] ABSTRACT

An ironing board of easily storable and readily accessible character which is particularly adaptable for minimization of utility space within a living area, the ironing board consisting of a board portion adapted for adjustable positioning and support in vertically affixed hanger members, and further including a brace member which is readily adjustable to support the board portion in horizontal disposition; the structure is further adapted so that the board portion can be folded upward adjacent a surface maintaining the vertical support members, and then clamped or suitably retained in that position with the brace member folded into linear alignment with the surface for storage during non-use.

4 Claims, 3 Drawing Figures

IRONING BOARDS

BACKGROUND OF THE INVENTION

1. Field of the Invention

The invention relates generally to ironing boards and, more particularly, but not by way of limitation, it relates to improvements in ironing boards, their accessibility and their storageability in space-saving manner.

2. Description of the Prior Art

The prior art includes many and varied types of ironing boards, usually of the well-known form and shape, and having various types of supporting structure, hanging structure and cabinet receiving structure. Many such designs of ironing board in combination with cabinet receiving structure have been necessitated in order to fulfill specified home design and other related functions, and in every case the crux of the inventions appears to have been the mechanical structure and manner in which foldability was imparted to the board, or in the particular cabinetry and integral mechanism for enabling the ironing board to function in combination therewith. The numerous prior art designs extend over a long number of years and are many and varied.

SUMMARY OF THE INVENTION

The present invention contemplates an ironing board which is particularly adapted for usage in living quarters having limited space, but may very well find extensive use in all manner and size of residence and like buildings. The ironing board consists of a board or work surface which is adjustably supportable in vertical support hangers which may be readily affixed on a selected vertical surface, e.g., a door back. A board brace is pivotally attached to the outer end of the ironing board and adapted for adjustable affixure in the support hanger to provide extended support of the ironing board, and the ironing board and brace are then foldable upward to be secured in parallel alignment with the vertical hanger thereby to provide out-of-the-way storage during non-use.

Therefore, it is an object of the present invention to provide an ironing board which can be readily stored in normally non-used space behind a seldom-used door when in open position and which is quickly accessible for work use.

It is also an object of the present invention to provide an ironing board which can be stored behind a selected door and yet released into operative position for use at the same location.

It is still further an object of the present invention to provide an ironing board assembly which can be quickly installed at a selected location in living quarters without the need for special tools and carpenter skills, and which is capable of being mounted without the use of screws or other mechanical means which might disfigure or mar the surface of the vertical supporting door.

Finally, it is an object of the present invention to provide an improved ironing board which has enhanced serviceability and storageability features, and which is especially adapted for use by apartment dwellers and the like wherein space is at a premium.

Other objects and advantages of the invention will be evident from the following detailed description when read in conjunction with the accompanying drawing which illustrates the invention.

DETAILED DESCRIPTION OF THE INVENTION

Figure 2:
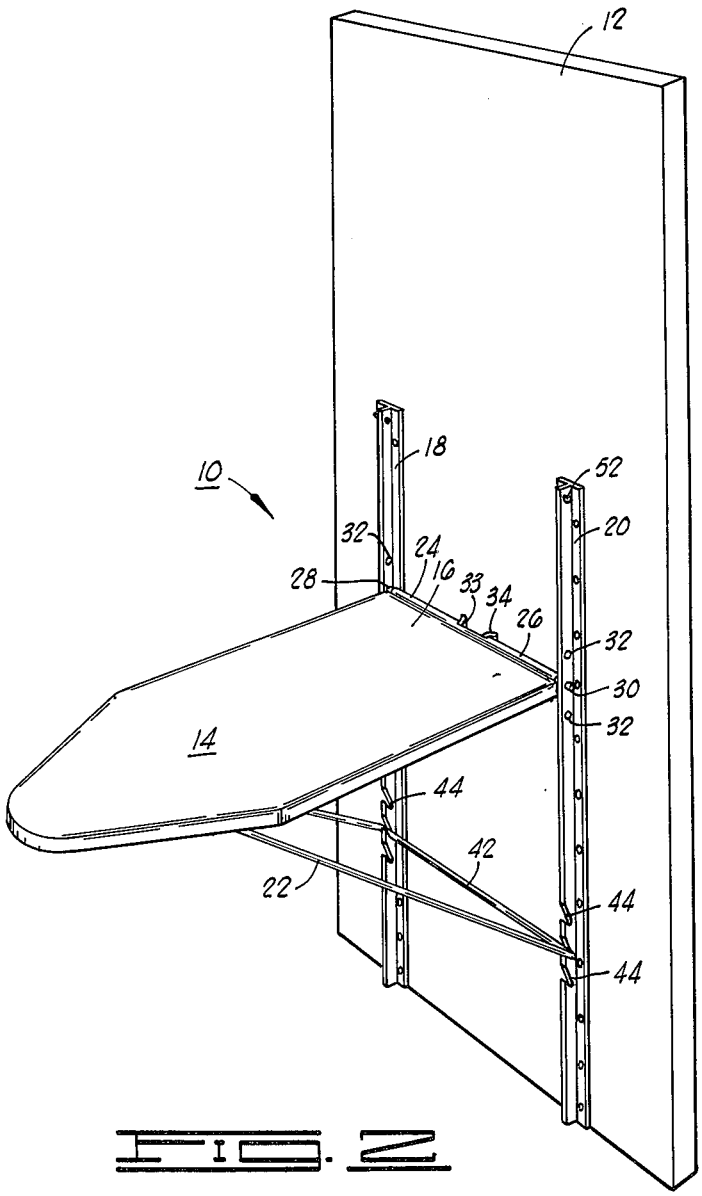
FIG. 2 illustrates the invention when removed to its nonstored or work use disposition.
Figure 1:
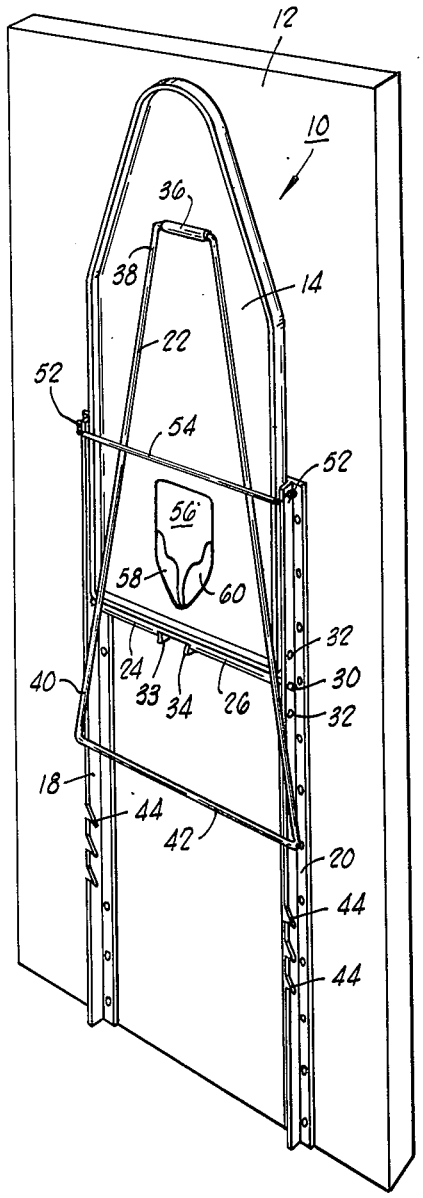
FIG. 1 illustrates the ironing board assembly as mounted on a vertical support and disposed in stored disposition.

Referring to FIG. 1, the ironing board assembly 10 is depicted in the stored position as mounted on a vertical support or door 12. The vertical support 12 as depicted in FIGS. 1 and 2, is the inside surface of a room door. It is well known that one of the very few places in a home that is clear of furniture or other obstructions is the aisle that must be left open in and around the doorway entries, but which space may be readily utilized by the present invention on a temporary basis while in work use. After usage, the door may be folded back against the wall to retain the ironing board assembly 10 out of sight.

FIG. 2 illustrates the ironing board assembly 10 as supported in its operative position wherein a board 14 is adjustably supported at a base end 16 to vertical support members 18 and 20 suitably affixed at desired height on door 12. A brace 22 is then adapted for pivotal affixure to the underside of board 14 to be further adjustably supported by vertical support members 18 and 20 to maintain board 14 parallel and in proper operating position. The vertical support members 18 and 20 may be fastened to door 12 by any of various conventional means; however, it is deemed desirable to bond support members 18 and 20 using one of the several commercially available contact cements which exhibit very high adhesive qualities yet can be removed with known household solvents to leave the surface of the door unmarred.

The base end of the ironing board 14 may be formed with suitable retaining channels 24 and 26 for retention of spring-loaded pivot rods 28 and 30, respectively. Tabs 33 and 34 then enable transverse movement of rods 28 and 30 during mounting and adjustment such that they can be released to allow rods 28 and 30 for insertion into a selected one of holes 32 in vertical support members 18 and 20.

The ironing board 14 may be either a metal or wooden type; however, the present design of the invention utilizes the more recently developed metal variety as adapted to receive a resilient ironing pad or cushion. The brace 22 is pivotally secured beneath the outer end of ironing board 14 along its central axis by means of a tubular retainer 36 suitably secured thereon, and retainer 36 is of proper size to receive upper end 38 of brace 22 therein in pivotal affixure. A lower end 40 of brace 22 is expanded outward to define a transverse section 42 of sufficient length to be engageable with a selected one of slots 44 in each of vertical support members 18 and 20 (as shown in FIG. 2).

Figure 3:
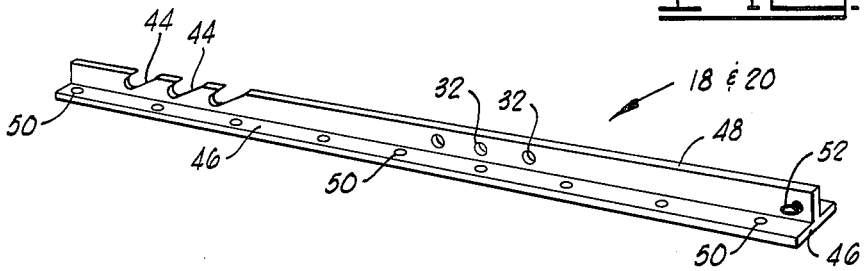
FIG. 3 illustrates one form of vertical hanger as may be utilized in the present invention.

FIG. 3 illustrates in enlarged perspective the particular construction of support members 18 and 20, each being of identical construction. Thus, the support member may be unitarily formed as an elongated T-shaped bar consisting of a backing panel 46 and center panel 48. The support members 18 and 20 may be constructed of any of various materials, but in the preferred form they are formed from one of the more well-known commercial and extrudable plastic materials, strength versus economy being the equating factor. For adjustment to various heights, the center panel 48 is formed to include a plurality of holes 32 for receiving the rod ends 28 and 30 to support the inner end 16 of ironing board 14 (see FIG. 2), and a plurality of slanted slots 44 are included near the base ends of support members 18 and 20 for the purpose of receiving the transverse section 42 of brace 22 when in operative position. As previously stated, each side of the base panel 46 of support members 18 and 20 may include a plurality of spaced holes 50 therethrough for the purpose of allowing additional gripping means for the quick setting bonding cement that is utilized as the fastener.

The upper ends of the support members 18 and 20 include a suitable form of fastening eye 52 (see also FIG. 2) for the purpose of receiving a hook-ended section of shock cord or spring material 54, the storage retainer element. It is also contemplated that a suitable formed iron appliance retainer 56 be suitably attached to the other side of ironing board 14 in order to provide storage for the iron appliance if so desired. The rack 56 may be a simple sheet metal formation having suitable toe walls 58 and 60 for supporting the iron appliance, and the rack 56 may be affixed as by spot welding to the underside of ironing board 14. It is yet further contemplated that the vertical support elements 18 and 20 be of a length to reach from the bottom of the door to the correct height desired. This enables more facile placement of the vertical support members 18 and 20 on the vertical wall of the door 12 without need for vertical measurements and alignments.

The present invention is intended as a space saving device suitable for this day and age when the ironing of clothing and household linens has become a more acute problem due to the ever increasing use of permanent press materials. No longer is a day set aside for washing and one for ironing. Most articles made of the permanent press materials need only touch-up ironing such that it is no longer necessary to set aside a full day for this tedious task. Thus, an average homemaker may need an ironing board only at infrequent and unscheduled minutes almost every day in order to do small touch-up ironing chores. This new necessity makes it impractical and unhandy to drag a heavy, folding ironing board out of a cluttered closet, set it up for use, and then put it back in storage daily, or even more often in some cases.

In operation of the present invention, each of the vertical support members 18 and 20 will be secured as by bonding to the back side of a room door or the like as shown in FIGS. 1 and 2. The inner end of the ironing board 14 is then positioned by thumb-finger squeezing of tabs 33 and 34 and placement of rod ends 28 and 30 in one of the holes 32 selected in accordance with the desired operating height. The ironing board 14 can then be folded upward against the door and between the center panels 48 of vertical support members 18 and 20, with brace 22 hanging straight in parallel relationship, and secured by the strap or shock cord member 54 between eye fasteners 52, thus retaining the ironing board in the stored position. The normally open door will enclose ironing board 14 from sight for all practical purposes.

When an ironing chore becomes necessary, it is only required to swing the door, remove shock cord 54, and lower ironing board 14 while guiding transverse section

42 of brace 22 into the selected slots 44 which render the ironing board 14 braced at the desired horizontal plane. The ironing board 14 is then ready for utilization. After ironing whatever the necessary clothing load, the ironing board 14 is simply swung upward against the door, as shown in FIG. 1, with replacement of shock cord 54 to hold it in stored position. The appliance rack 56 provides a place where the hot but cooling ironing appliance may be held without accident or burning and marring of surrounding fixtures.

The foregoing discloses a novel invention which is concerned with the provision of an ironing board that may be quickly attached to the back of a bedroom or little-used door, or any selected free access area in the residence, so that when the ironing board is folded up and flat against the vertical support it takes up little or no living space. When it is utilized with a residence door, it remains out of sight while the door is open in its normal disposition. When used on the back of a door, closure of the door provides an automatic, secure latch and thus provides an immovable support for the broad end of the ironing board, thus obviating the necessity for the provision of legs supporting the outer end of the board. The invention makes provision for a unitized, lightweight frame which is readily affixed in storageable manner on the selected vertical support area by either contact adhesive or other fasteners, and the unskilled can readily place the assembly in its operative position.

Changes may be made in the combination and arrangement of elements as heretofore set forth in the specification and shown in the drawings; it being understood that changes may be made in the embodiments disclosed without departing from the spirit and scope of the invention as defined in the following claims.

What is claimed is:

1. An ironing board assembly for use in combination with a selected vertical supporting door surface, comprising:

ironing board means of planar character having a squared end and an angled end;

first and second vertical support members arranged for parallel, bonded disposition to said door surface, said vertical support members each having a base panel for bonding to said door surface and an additional panel for receiving the squared end of said ironing board in rigid affixure as well as a plurality of brace receiving slots disposed at selected height from the door surface bottom;

first and second securing means for pivotally securing the squared end of said ironing board to said first and second vertical support members;

brace means pivotally affixed to the angled end of said ironing board means, said brace means being securable in said slots at the lower end of each said vertical support member to brace said ironing board means in its horizontal operative position; and second securing means of resilient consistency affixed to said first and second vertical support members and adaptable to retain said ironing board means in a stored position parallel to said vertical door surface.

2. An ironing board assembly as set forth in claim 1 wherein said ironing board means further includes:

first and second spring loaded rod means extending transversely outward at the squared end of said ironing board means for affixure through respective panels of said first and second vertical support members at a designated height on said vertical surface.

3. An ironing board assembly as set forth in claim 1 wherein said second securing means comprises:

an elongated resilient member including on each end means for attachment to the upper end of respective first and second vertical support members.

4. An ironing board assembly as set forth in claim 1 wherein said first and second vertical support members each include:

plural equi-spaced holes disposed through said center panel at generally the mid-section for receiving said first securing means at a selected position;

plural equi-spaced angular slots disposed in said center panel adjacent the lower end of said member for receiving said brace means; and attaching means disposed at the opposite upper end of said member for receiving in affixure said second securing means.

* * * * *